United States Patent [19]

Armstrong et al.

[11] Patent Number: 4,577,794

[45] Date of Patent: Mar. 25, 1986

[54] RIVET INJECTOR/REJECTOR DEVICE

[75] Inventors: Thomas E. Armstrong, Issaquah; Douglas L. Boob, Kent; Homer R. Burrous, Bellevue; Oldrich Fryc, Renton; David L. Wagner, Kent, all of Wash.

[73] Assignee: The Boeing Company, Seattle, Wash.

[21] Appl. No.: 679,238

[22] Filed: Dec. 7, 1984

[51] Int. Cl.[4] ..... B21J 15/28; B21J 15/32

[52] U.S. Cl. ..... 227/119; 29/710; 221/13; 221/21; 221/157; 227/1; 227/112; 227/149

[58] Field of Search ..... 29/709, 710; 221/13, 221/21, 157; 227/1, 112, 118, 19, 149, 150

[56] References Cited

U.S. PATENT DOCUMENTS

| | | | |
|---|---|---|---|
| 434,214 | 8/1890 | Thomson | 227/149 X |
| 1,528,897 | 3/1925 | Stimpson | 227/119 |
| 2,554,982 | 5/1951 | Hartey et al. | 29/710 X |
| 2,809,541 | 10/1957 | Witt | 221/13 X |
| 2,896,208 | 7/1959 | Alderman et al. | 227/149 |
| 3,030,832 | 4/1962 | Filangeri et al. | 227/5 |
| 3,049,713 | 8/1962 | Dupuy et al. | 227/112 |
| 3,081,885 | 3/1963 | Carlzen et al. | 227/149 |
| 3,275,191 | 9/1966 | MacDonald | 221/175 |
| 3,334,785 | 8/1967 | Grabowski et al. | 221/88 |
| 3,339,799 | 9/1967 | Spisak | 221/176 |
| 3,554,403 | 1/1971 | Ginther et al. | 221/93 |
| 3,608,687 | 9/1971 | Schulz et al. | 221/157 |
| 3,883,040 | 5/1975 | Bell | 221/224 |
| 3,900,131 | 8/1975 | Ehrlich | 221/169 |
| 3,993,216 | 11/1976 | Poole | 221/93 |
| 4,180,195 | 12/1979 | Caley et al. | 227/51 |
| 4,208,153 | 6/1980 | Trethewy | 406/72 |

*Primary Examiner*—Paul A. Bell

*Attorney, Agent, or Firm*—Bruce A. Kaser; Delbert J. Barnard

[57] ABSTRACT

A rivet injector/rejector device (10) is provided for use with a riveting machine (12) having a plurality of rivet gripping fingers (120, 122). The device (10) includes a supporting member (16) fixedly mounted to the riveting machine (12). A tubular member (92) is provided for delivering a rivet (148) to the fingers (120, 122). The tubular member (92) is mounted to the supporting member (16) so that an end portion (118) of the tubular member may be moved downwardly relative to the fingers (120, 122). The end portion (118) is shaped so that as it moves downwardly it spreads the fingers thereby permitting a rivet to drop free therefrom.

8 Claims, 11 Drawing Figures

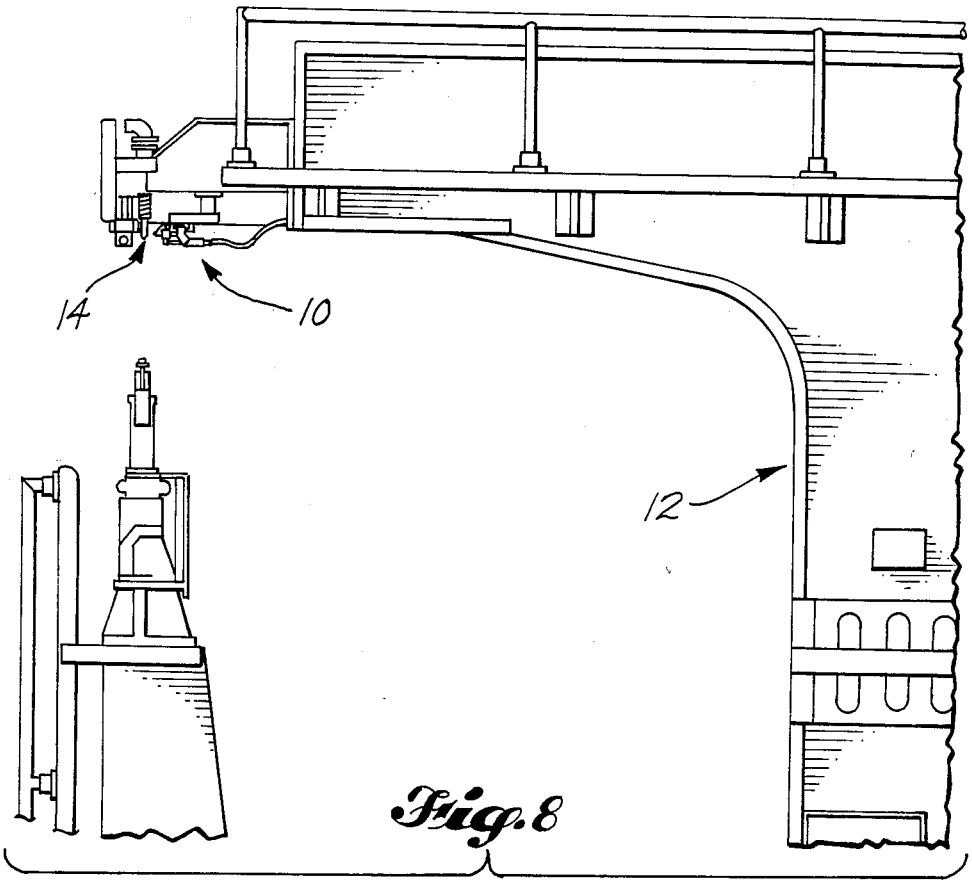
Fig. 8
Fig. 9
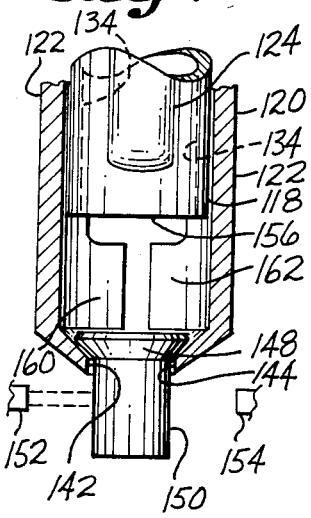
Fig. 10
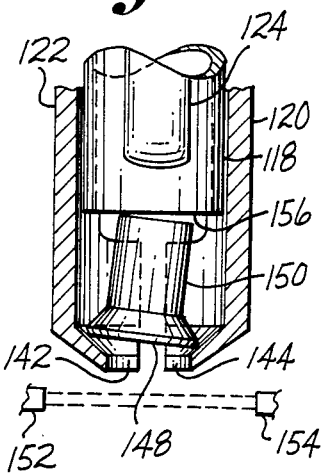
Fig. 11
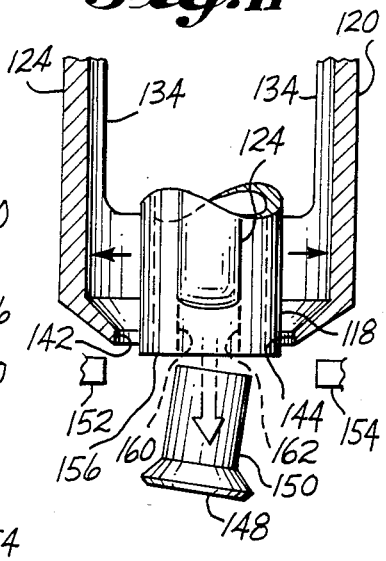

RIVET INJECTOR/REJECTOR DEVICE

DESCRIPTION

1. Technical Field

This invention relates to a device that delivers rivets to rivet gripping fingers of an automatically controlled riveting machine. More particularly, this invention relates to a device that can quickly inject and stabilize a rivet in such fingers, or subsequently reject the rivet if it is incorrectly oriented in the fingers or if the operator decides to reject the rivet for any other reason.

2. Background Art

Riveting machines for attaching structural members together are, of course, well-known in the art. Many of such machines are designed for automatic operation. Such automatically operated machines typically clamp onto a workpiece (or workpieces) and then drill a hole or holes in the workpiece. The machine then inserts a rivet in the drilled hole and the rivet is then squeezed or compressed. The rivet is delivered to the hole by rivet gripping fingers that shuttle back and forth between the drilled hole and a rivet delivery device which is mounted to the riveting machine.

A riveting machine that operates in the manner described above has been constructed by the Drivmatic Division of the Gemcor Company of Buffalo, N.Y. By way of example only, such a machine may be identified by Gemcor Ser. No. 929, and Model No. G-400BH/39A-120/G79-CNC. The Gemcor machine has a rivet injector system for feeding or injecting rivets into the rivet gripping fingers. In the past, the Gemcor injector system has been used in conjunction with a rivet feed system, wherein rivets are manually fed to the injector system by an operator of the machine. After years of service this type of system has proven itself to be reliable, but it is too slow for automated rather than manual rivet feeding.

In the Gemcor injector system, a rivet is first delivered to a rivet orienting device which is positioned above a sliding injector member. The rivet is oriented by this device into a head-up position. Then, the rivet is fed through a track to a chamber in the injector member by means of a vibration feed mechanism. The rivet is then pushed by the injector member through spring-closed guiding jaws and into the rivet gripping fingers. Typically, two rivet gripping fingers will be used to grip the rivet. A vertical slit between the two fingers contains a ramp surface that is used to spread the fingers when the rivet is pushed against them by the sliding injector member. When the rivet is fully within the fingers, the fingers close, thereby clamping on the shank of the rivet.

Occasionally, a rivet is not properly received within the rivet fingers and it must be rejected. The Gemcor rivet injector system accomplishes rivet rejection by introducing another rivet for delivery to the fingers, and using this second rivet to push the first rivet out of the fingers. This type of rejection generally works well, but it is not totally reliable. More importantly, the rejection feature of the Gemcor injector system is incompatible with an automatic rivet feed system because the sliding injector member utilizes to much time in performing a rejection operation.

The Gemcor rivet injector has proven to be a reliable and efficient device when rivets are manually fed to the rivet injector. If, however, the manual task of feeding the rivet is to be replaced by an automatic feed system, then the currently existing Gemcor injector system is unsuitable because it is too slow to perform an injection and/or rejection operation so as to keep up with rivets delivered from the automatic feed system. In other words, the automatic feed system may be delivering a rivet to the rivet injector at a relatively constant rate. The injector must have the capability of injecting each rivet as it is received from the feed system. Furthermore, it must have the capability of quickly rejecting an improperly oriented rivet so that the next subsequently fed rivet received from the automatic feed system may be injected into the fingers.

Another type of rivet injector system known in the prior art is the system described by Caley et al in U.S. Pat. No. 4,180,195 issued on Dec. 25, 1979. Caley solves injector slowness problems associated with the Gemcor injector system by delivering a rivet into the machine fingers in a preoriented position. However, the Caley system does not provide a means for rejecting rivets from the fingers. In Caley, if a first rivet is delivered to the fingers and the machine operator then decides to replace it with a second rivet, either because it is incorrectly oriented or for other reasons, then no provision exists for rejecting the first rivet. The machine operator must therefore manually remove the rivet. A person skilled in the art would know that the Gemcor machine is a machine of large dimension. For the operator to manually remove the rivet it would typically require first removing a workpiece and then climbing up to the injector device by means of a ladder. This is an inefficient and time consuming task. Another drawback to Caley is that Caley does not provide a feed system having the capability of quickly changing the size of rivet feed tubes to accommodate varying diameters of rivets which are fed to the machine. For example, if the operator has been feeding rivets to the machine having a particular size and then wishes to feed rivets of a different size, he must then switch to a differently sized rivet delivery tube. Caley does not provide a means for quickly changing differently sized delivery tubes.

A durable injector/rejector mechanism is not easy to design for installation in the limited access space provided by the Gemcor machine. For example, a proposed solution was to design tiny levers that would spread the fingers and let a rivet drop in a rejection situation. It was found that although the fingers would meet limited access requirements, they were not durable enough so as to ensure reliability. As will become apparent upon further reading of this application, the present invention addresses the various problems described above which are associated with both the Gemcor and Caley injector systems, and provides a rivet injector/rejector device that is simple in construction, durable, and reliable in operation.

DISCLOSURE OF THE INVENTION

The present invention provides a rivet injector/rejector device that is suitable for use in conjunction with an automatically controlled riveting machine, wherein the machine has two matched rivet holding or gripping fingers that shuttle back and forth between the injector/rejector device and a workpiece. The present device, in basic form, includes a supporting member fixedly mounted to the riveting machine, and a tubular member connected to the supporting member. The tubular member delivers a rivet to the rivet machine fingers and is mounted to the supporting member in a manner so that the end portion of the tubular member may be moved downwardly relative to the fingers, to reject a rivet from the fingers during certain conditions.

The tubular member includes an end portion that is positioned and shaped so that normally the machine fingers will be spread as they are moved toward and against the tube end portion. During normal operation, a rivet is delivered to the fingers in a head- up position, with the shank portion of the rivet extending downwardly from the fingers. In such a situation, the fingers merely shuttle to the tubular member, receive a rivet therefrom via its end portion, and shuttle away from the tubular member to the workpiece. Sometimes, however, the rivet may be delivered to the fingers upside down wherein the shank portion of the rivet does not properly extend downwardly from the fingers. In this case, the injector/rejector device includes a means for moving the end portion of the tubular member downwardly, spreading the fingers sufficiently to permit the rivet to drop from the fingers and the end portion. The end portion is shaped for sufficiently spreading the fingers and moves a sufficient distance downwardly for permitting the rivet to drop free. After rejection, the end portion is moved upwardly back into its normal position for delivering another rivet to the fingers.

The means for moving the end portion of the tubular member downwardly relative to the fingers may include pivotally connecting the tubular member to the supporting member. The injector/rejector device is provided with a tilt base for this purpose. The tilt base is pivotally connected to the supporting member (which is fixedly mounted to the riveting machine), and a portion of the tubular member is fixedly connected to the tilt base. When the tilt base is pivoted relative to the supporting member, the end portion of the tubular member moves downwardly or upwardly in accordance with the direction of tilt base pivotal movement.

An actuator, of a pneumatic type or otherwise, is provided for pivoting the tilt base relative to the supporting member. The actuator includes first and second ends which are extendible and retractable relative to each other. The first end of the actuator is connected to the tilt base, and the second end is connected to a fixed support means, in a manner so that extension and retraction of the actuator causes the tilt base to pivot relative to the supporting member. The fixed support means may be included as a structural portion of the fixed supporting member. For example, the supporting member may be provided with mounting arms which extend downwardly therefrom, wherein the second end of the actuator is pivotally connected to the ends of the downwardly extending arms.

An advantage to the present invention is that it provides an injector/rejector device that can quickly inject and stabilize a rivet that is fed to the machine fingers. Furthermore, the device can quickly, and in a nonpassive manner, reject a rivet from the fingers when the rivet is delivered in an incorrect orientation. In many prior art rivet rejection systems, an incorrectly oriented rivet is rejected by means of delivering another rivet to the fingers, wherein the subsequently delivered rivet forces the prior rivet out of the fingers. This type of system has proven unreliable for consistently rejecting incorrectly oriented rivets.

An associated advantage to the advantage stated in the above paragraph is that the present invention provides an injector/rejector device that is adaptable to a currently existing riveting machine (the Gemcor machine) without hardware revision of the machine. The present device can inject and stabilize a rivet in the Gemcor machine fingers, and if necessary, reject a rivet and inject another rivet, or even reject and inject subsequent rivets, if necessary, until a rivet is properly delivered.

Another advantage of the present invention is that it provides a means for quickly interchanging differently sized rivet delivery tubes. The device includes a first frame mount connected to the tilt base that tilts as the tilt base pivots. A second frame mount is connected to a portion of the tubular member. The first tilt base mount includes outwardly projecting pins that register with openings in the second tubular frame mount, to connect the two mounts together. A latching member holds the mounts adjacent each other in a manner so that they cannot be pulled apart. Thus, differently sized tubular members each may be provided with the same-sized frame mount so that such tubes can quickly be interchanged if desired and still maintain precision alignment.

Still another advantage to the present invention is that it provides a rivet injector/rejector device that is sturdy, simple in construction, and therefore reliable.

These and other advantages will become readily apparent to the reader upon reading the next part of this application.

BRIEF DESCRIPTION OF THE DRAWINGS

In the drawings, wherein like reference numerals refer to like parts throughout the various views:

FIG. 8 is a partial side elevation of a Gemcor riveting machine, and shows the connection of the injector/rejector device to the machine;

FIG. 9 is an enlarged side elevation of the forward end of the rivet delivery tube shown in FIGS. 1–4, showing the rivet fingers in section, and shows a rivet correctly delivered from the rivet delivery tube into the fingers;

FIG. 10 is a view like FIG. 9, but shows a rivet incorrectly delivered to the rivet fingers;

FIG. 11 is a view like FIGS. 9 and 10, but shows an incorrectly delivered rivet being rejected from the fingers by downward movement of the end of the rivet delivery tube, such movement resulting from the manuever shown in FIG. 4.

BEST MODE FOR CARRYING OUT THE INVENTION

Figure 1:
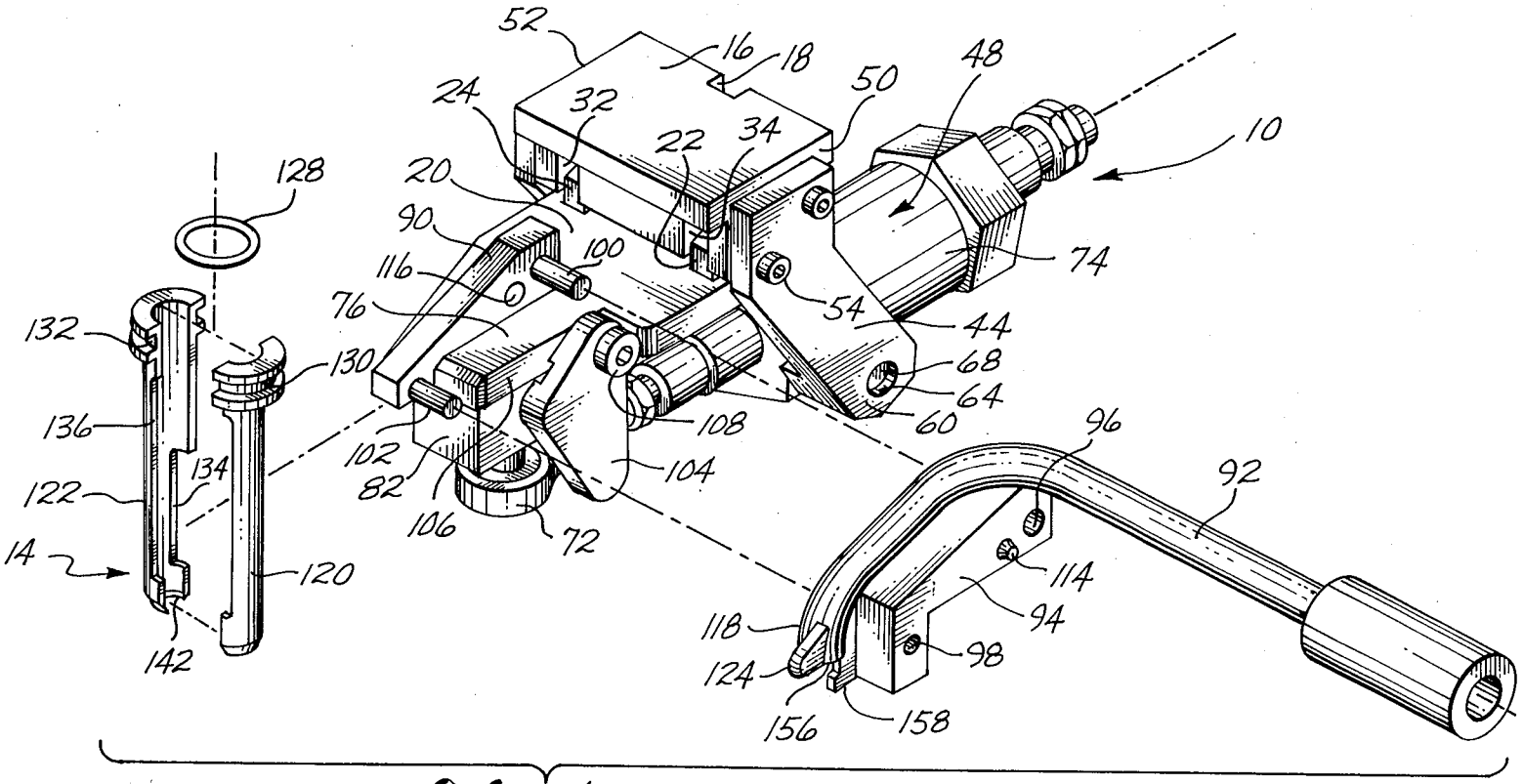
FIG. 1 is a partially exploded view of a rivet injector/rejector device constructed in accordance with a preferred embodiment of the present invention, wherein this view shows a rivet delivery tube mountable to the device for delivering a rivet to a pair of fingers spaced a distance from the forward portion of the device.

Referring now to the drawings, therein is indicated by reference numeral 10 an injector/rejector apparatus or device constructed in accordance with a preferred embodiment of the instant invention. The device 10 depicted in the drawings is designed for use on a Gemcor-type riveting machine 12. A portion of such a machine is shown in FIG. 8 and was described in the background art portion of this application. The device 10 is mounted to the riveting machine 12 at a location so that a pair of rivet fingers 14 may shuttle back and forth between the device 10 and a hole or holes drilled in a workpiece. Directing attention to FIG. 1, the various parts of the device 10 will first be described, and then a description of the device's operation will follow.

The rivet injector/rejector device 10 includes a supporting member 16 adapted for attaching the device 10 to the riveting machine 12. The supporting member 16 may be latched into position on the riveting machine 12 by means of a latching slot 18 provided in the supporting member. A person skilled in the art would, of course, be familiar with both the Gemcor riveting machine 12 and the method by which the supporting member 16 could be latched onto that machine by the latching slot 18.

Figure 2:
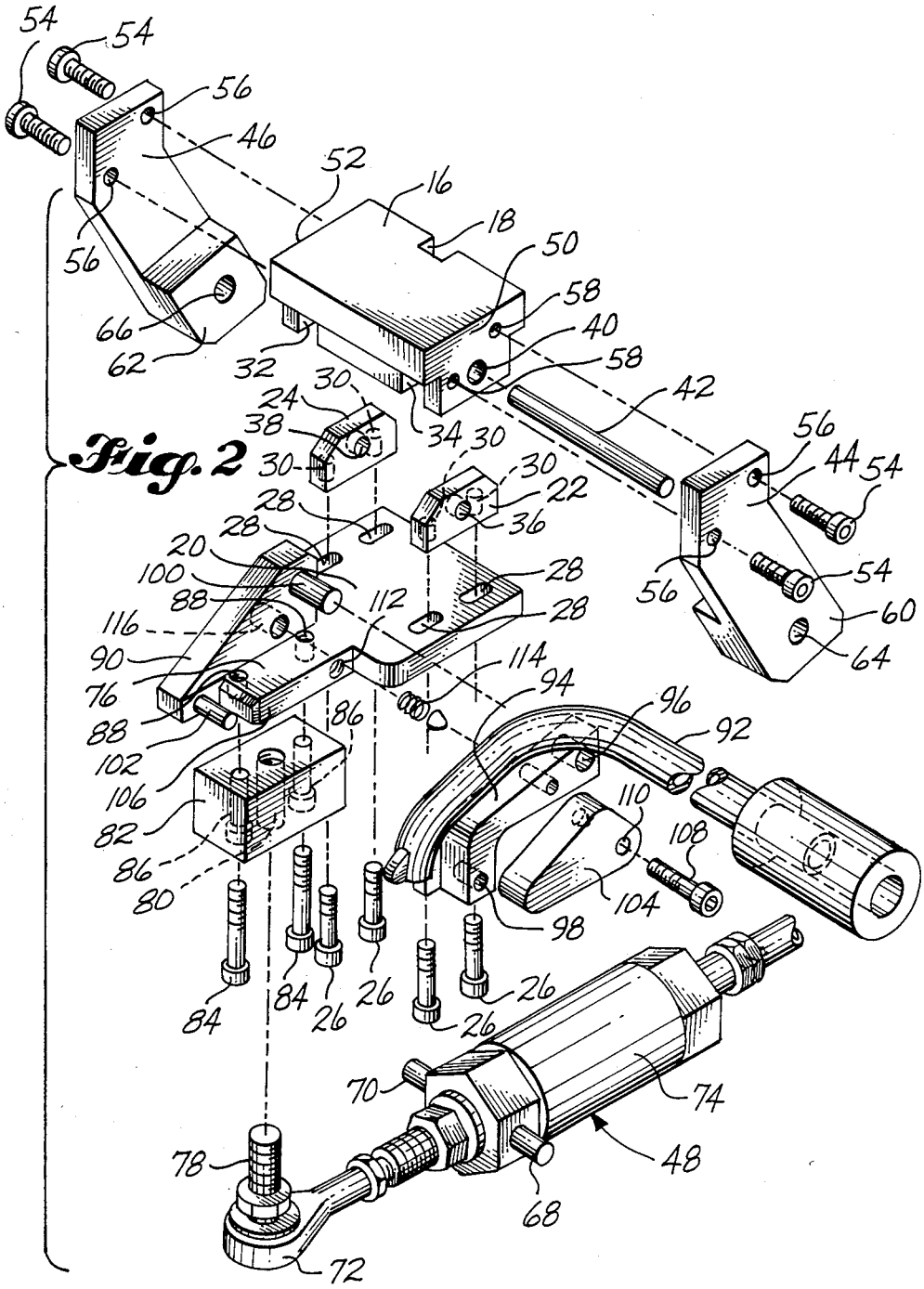
FIG. 2 is a fully exploded view of the rivet injector/rejector device shown in FIG. 1.

A tilt base 20 is pivotally connected to the supporting member 16. Referring now to FIG. 2, in preferred form the tilt base 20 is connected to the supporting member 16 by means of a pair of pivot mounts 22 and 24. The pivot mounts 22, 24 are connected to the tilt base 20 by Allen-type screws 26 which are inserted through slots 28, and which are received by threaded bores 30 in the pivot mounts 22, 24.

The supporting member 16 may be constructed in the form of a block having slots 32, 34 on its downward side for receiving the pivot mounts 22, 24. The pivot mounts 22, 24 have bores 36, 38 which register with a transverse bore 40 in the supporting member 16. A pivot pin 42 is passed through the bore 40 in the supporting member 16, and the bores 36, 38 in the pivot mounts 22, 24, to pivotally connect the tilt base 20 to the supporting member 16. The pin 42 is held in place by downwardly extending arms 44, 46, which are provided for the purpose of connecting an actuator 48 to the device 10.

The actuator arms 44, 46 are attached in flush relationship to side portions 50, 52 of the supporting member 16 by Allen screws 54, or similar means. The Allen screws 54 are passed through bores 56 in the upper portions of the actuator arms 44, 46, and the screws are received by threaded bores 58 in the supporting member 16. It should be apparent that attaching the actuator arms 44, 46 to the supporting member 16 in this manner would hold the pivot pin 42 in place in the supporting member. The downwardly extending end portions 60, 62 of each actuator arm 44, 46 have bores 64, 66 for pivotally receiving a pair of trunions 68, 70. One trunion is mounted to each side of the actuator 48 and is received by that bore 64, 66 which is adjacent its side of the actuator.

The actuator 48 may be in the form of a typical pneumatic type cylinder having an end portion 72 that is extendible and retractable relative to the cylinder housing 74. The end portion 72 of the actuator 48 is connected to a forward portion 76 of the tilt base 20. The cylinder end 72 is connected to the tilt base forward portion 76 by a bolt 78, connected to the cylinder end 72, that is threaded into a bore 80 in a connecting block 82. The connecting block 82 is connected to the tilt base forward portion 76 by bolts 84 which pass through bores 86 in the connecting block 82. The bolts 84 are then received by threaded bores 88 in the tilt base forward portion 76.

It can be appreciated that the construction of the device 10 as described herein permits the actuator or cylinder 48 to be used to pivot the tilt base 20 about the axis defined by the pivot pin 42. Retracting and extending the cylinder end 72 relative to the cylinder body 74 would cause the tilt base 20 to tilt downwardly and upwardly, in accordance with such retraction or extension.

The forward portion 76 of the tilt base 20 includes a frame mount 90 that is used for mounting a rivet delivery tube 92 to the tilt base. In preferred form, the tilt base is milled from steel. The tilt base frame mount 90 may be formed as a portion of the tilt base in the manner shown in the drawings, or the frame mount could be fabricated separately and connected to the tilt base by other means.

Connected to the rivet delivery tube 92 is a second frame mount 94 which connects the tube to the tilt base frame mount 90. The second frame mount 94 includes bores 96, 98 that register with pins 100 and 102 projecting outwardly from the tilt base frame mount 90. Once the delivery tube frame mount 94 is connected to the tilt base frame mount 90, the two frame mounts 90, 94 may be held in place adjacent each other by a latching member 104. The latching member 104 is pivotally connected to a side portion 106 of the tilt base 20 by a shoulder screw 108. The shoulder screw 108 passes through a bore 110 in the latching member 104 and is received by a threaded bore 112 in the side portion 106 of the tilt base 20. The latching member 104 may be pivoted upwardly adjacent the delivery tube frame mount 94, thereby sandwiching the delivery tube frame mount 94 between the tilt base frame mount 90 and the latching member 104. This prevents the delivery tube frame mount 94 from being pulled away from the tilt base frame mount 90 once they are joined together by the pins 100, 102 and bores 96, 98 in each respective frame mount. The latching member 104 may be held in position by a spring plunger assembly 114 that is received within an opening 116 in the tilt base frame mount 90.

Figure 3:
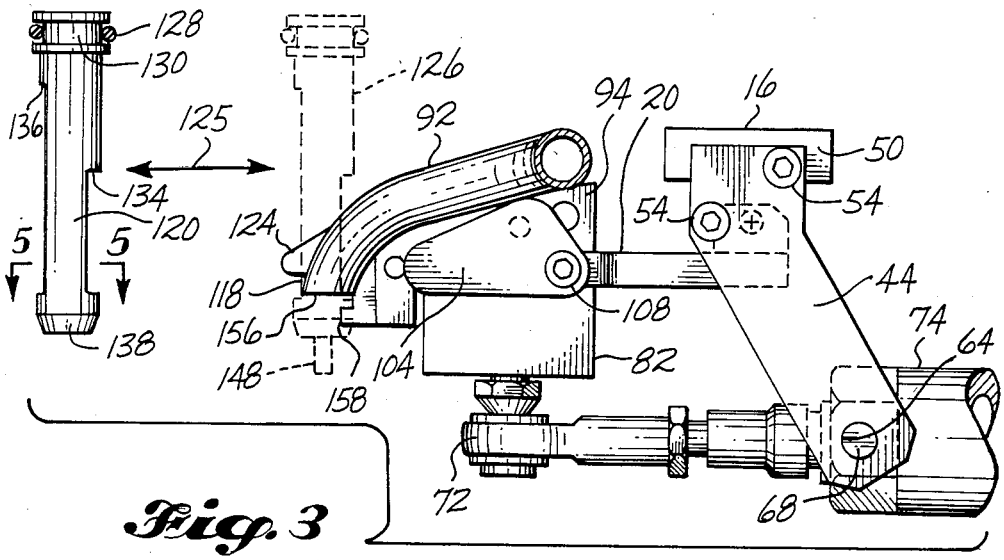
FIG. 3 is a side elevational view of the device shown in FIGS. 1 and 2, and shows rivet machine fingers shuttling back and forth toward and away from the rivet injector/rejector device.
Figure 4:
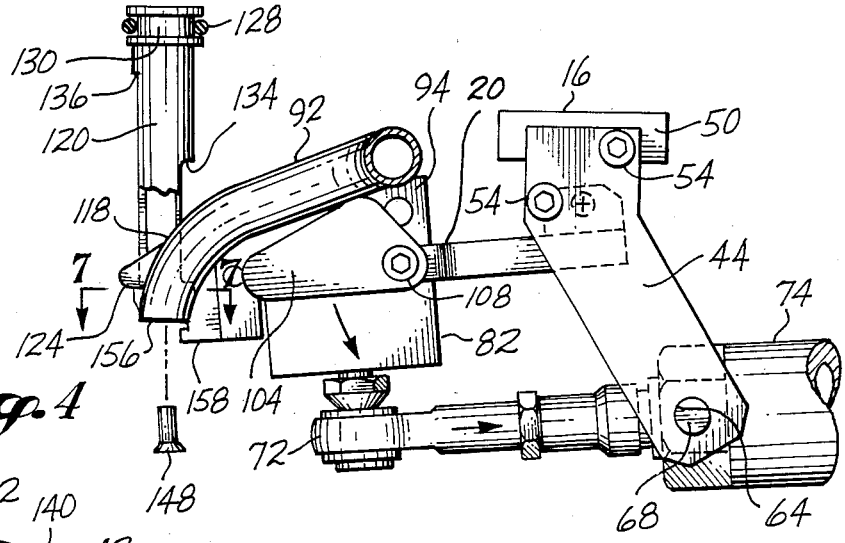
FIG. 4 is a view like FIG. 3, but shows the device performing a rivet rejection manuever for rejecting a rivet from the rivet fingers by downwardly pivoting a tilt base of the device, the pivoting movement being caused by the retraction of an actuator.
Figure 5:
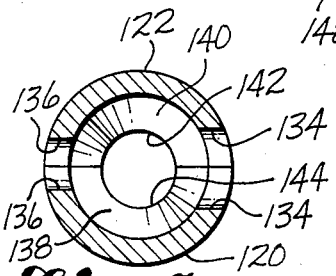
FIG. 5 is a cross sectional view of the rivet fingers shown in FIGS. 1, 3 and 4, and is taken along line 5—5 in FIG. 3.
Figure 6:
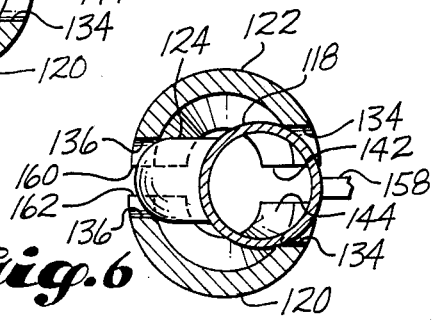
FIG. 6 is a cross sectional view of the rivet fingers of FIG. 3, and shows the spreading of the fingers as the fingers move toward and against the end portion of the rivet delivery tube shown in FIGS. 1–4.

Referring to FIG. 1, the rivet delivery tube 92 has an end portion 118 through which a rivet is delivered to the rivet fingers 14. FIGS. 1 and 3 show a pair of rivet fingers 120 and 122 in position for shuttling back and forth (indicated generally by the direction of arrow 125) between the device 10 and a drilled hole in the workpiece. The construction of the fingers 120 and 122 would be familiar to a person skilled in the art. By way of example only, the fingers 120, 122 could be connected together by an annular spring member 128 that is received in grooves 130, 132 in the top ends of the fingers. As the fingers 120, 122 move toward the device 10, into the position shown by the dashed lines 126, a cam portion 124 of the tube end 118 spreads the fingers in a manner so that the tube end 118 is positioned in the region between the spread fingers. This process is illustrated in FIGS. 5 and 6. FIG. 5 shows the fingers 120, 122 in a nonspread condition prior to contacting the tube end portion 118. FIG. 6 shows the fingers 120, 122 in a partially spread condition as the tube end 118 simultaneously spreads the fingers 120, 122. Each finger 120, 122 has a forward notch region 134 through which the cam portion 124 of the tube end 118 first passes. As the fingers 120, 122 continue to travel from left to right (see FIG. 3), the cam portion 124 then passes through an aft groove region 136 in each finger 120, 122, as indicated by dotted line 126. The fingers continue to move from left to right until they are in a "home" position which is shown in FIGS. 3, 4 and 9. When in this position, the tube end 118 is in position between the fingers and the fingers are ready to receive a rivet from the rivet delivery tube 92.

Rivets are fed by means of a pressurized airflow through the rivet delivery tube 92 to the rivet fingers 120, 122. The lower ends of the fingers 120, 122 have conically shaped surfaces 138, 140 which guide a delivered rivet adjacent the rivet shank gripping surfaces 142, 144 of the fingers. If a rivet is properly delivered to the fingers 120, 122, the rivet will be in the position of rivet 148 shown in FIG. 9. As can be seen, the shank portion 150 of the rivet 148 extends downwardly from the shank gripping surfaces 142, 144.

In most present day automatic riveting machines, the machines are equipped with photoelectric sensing devices for sensing whether or not the rivet is properly positioned in the fingers 120, 122. Generally, such photoelectric devices include a light emitting device, indicated schematically at 152, and a light receiving device, indicated schematically at 154. If the shank portion 150 of the rivet 148 is in a correct orientation and extends downwardly from the rivet fingers 120, 122, then the light transmission between the light emitter 152 and the light receiver 154 will be blocked. In this case, the internal control logic of the riveting machine 12 is signaled by the blocked transmission that the rivet 148 is in the correct orientation in the fingers 120, 122.

Figure 7:
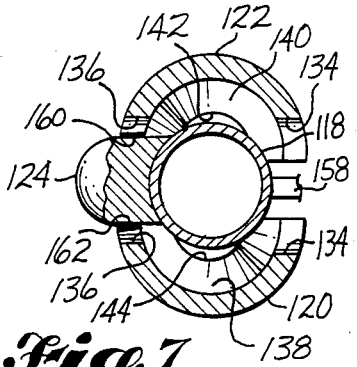
FIG. 7 is a view much like FIG. 6 but is taken along line 7—7 of FIG. 4, and shows further spreading of the fingers after the fingers are fully engaged and the end of the tube is in the down position.

It is possible that the rivet 148 may be delivered to the fingers 120, 122 in an upside down or head down position as shown in FIG. 10. In this case, since the shank portion 150 of the rivet does not extend downwardly from the fingers 120, 122, then the light transmission between the light emitter 152 and the light receiver 154 is not blocked. This signals the machine control logic that the rivet 148 is incorrectly oriented in the fingers. If this occurs, the cylinder 48 is then retracted in the manner shown in FIG. 4, to cause the tilt base 20 to pivot downwardly. This in turn causes the end portion 118 of the delivery tube to travel downwardly. The tilt base 20 is tilted sufficiently so that the cam portion 124 contacts and spreads the fingers 120 and 122 at surfaces 160 and 162 as shown in FIG. 7. The end portion 118 spreads the fingers 120, 122 causing the rivet 148 to drop free from the fingers as shown in FIGS. 4 and 11. The cylinder 48 is then extended to pivot the tilt base 20 back into a rivet delivering position, so that another rivet may be delivered to the fingers. Thus, a rivet improperly delivered to the fingers 120, 122 can be quickly rejected, and another rivet can be quickly delivered to the fingers.

Positioned below the end opening 156 of the tube end portion 118 is a rivet stopping member 158. This member 158 is provided for stabilizing the rivet 148 as it is fed into the fingers 120, 122 when the fingers are in the "home" position shown by the dashed lines 126 in FIG. 3. The end portion 118 (including the shape of the cam portion 124 and the rivet stopping member 158) is constructed so that no revision need be made to the fingers 120, 122 on a Gemcor machine upon installation of the device 10. It should be appreciated that the slots 28 in the tilt base 20 would permit a certain amount of adjustment in the position of the end member 118 relative to the fingers 120, 122 if such adjustment should be necessary.

The means by which the rivet delivery tube 92 is mounted to the tilt base 20 provides easy interchangeability between differently sized rivet delivery tubes while maintaining precision alignment. The frame mount 90 (connected to the tilt base 20) and the mount 94 (connected to the rivet delivery tube 92) are positioned so that a rivet delivery tube can be easily connected or disconnected from the device 10 without making hardware revisions in the Gemcor machine. Differently sized tubes need only have the same size frame mount 94 for quick connection and disconnection of such tubes.

Lastly, the device 10 is constructed so that it can be mounted to the riveting machine 12 without modifying the currently existing photoelectric sensing device that is on the machine.

The description of the injector/rejector device 10 provided above is to be used only for illustrative purposes and not for limiting the scope of patent coverage. It is to be understood that patent coverage is to be limited only by the appended claims which follow, in accordance with the established doctrines of patent claim interpretation.

What is claimed is:

1. A rivet injector/rejector apparatus for use with a riveting machine having a plurality of rivet gripping fingers that are movable back and forth between the injector/rejector and a workpiece, the fingers being spreadable relative to each other and having surfaces for gripping a shank portion of a rivet received from the injector/rejector, the gripping surfaces holding the rivet while it is delivered from the injector/rejector to the workpiece, the apparatus comprising:

a supporting member mounted fixedly to said riveting machine;

a tubular member for delivering the rivet to the fingers, the tubular member having an end portion that is positioned and shaped to spread the fingers when the fingers are moved toward the injector/rejector and against the end portion, for the purpose of injecting a rivet into a region between the fingers that is adjacent their shank gripping surfaces, the tubular member being connected to the supporting member in a manner so as to permit downward movement of the end portion relative to the fingers; and means for moving the end portion downwardly relative to the fingers, to reject a rivet from the fingers during certain conditions, and wherein the end portion is shaped for sufficiently spreading the fingers during such downward movement so that a received rivet is rejected free of the fingers by dropping therefrom.

2. The rivet injector/rejector apparatus of claim 1, wherein the tubular member is pivotally connected to the supporting member.

3. The rivet injector/rejector apparatus of claim 2, including a tilt base pivotally connected to the fixedly mounted supporting member, and wherein a portion of the tubular member is fixedly connected to the tilt base in a manner so that when the tilt base pivots relative to the supporting member the end portion of the tubular member moves downwardly or upwardly in accordance with the direction of pivotal movement of the tilt base.

4. The rivet injector/rejector apparatus of claim 3, including an actuator having first and second ends extendible and retractable relative to each other, wherein the first end is connected to the tilt base, and wherein the second end is connected to a fixed support means in a manner so that extending and retracting the first end relative to the second end causes the tilt base to pivot relative to the fixed supporting member.

5. The rivet injector/rejector apparatus of claim 4, wherein the fixed support means includes at least one mounting arm connected to the supporting member and extending downwardly therefrom, with the second end of the actuator being pivotally connected to the end of the downwardly extending arm.

6. The rivet injector/rejector apparatus of claim 5, wherein the tubular member is sized for delivering a rivet of a particular size, and including means for interchangeably mounting and latching to the tilt base another tubular member having a different size.

7. The rivet injector/rejector apparatus of claim 6, wherein the mounting and latching means comprises a first frame mount connected to the tilt base and having at least one pin outwardly projecting from the first frame mount, and a second frame mount connected to a portion of the tubular member, the second frame mount having an opening sized to register with each pin that projects outwardly from the first frame mount, wherein the tubular member is connected to the tilt base by positioning the second frame mount adjacent the first frame mount and having pin-to-hole registration of each pin of the first frame mount with each opening of the second frame mount, and further including a latching member pivotally connected to the tilt base, wherein when the first and second frame mounts are connected adjacent each other the latching member may be positioned adjacent the second frame mount, in a manner so as to prevent the first and second frame mounts from being pulled apart.

8. The rivet injector/rejector apparatus of claim 7, wherein the end portion includes an end opening through which a rivet may be delivered from the tubular portion to the fingers, the end portion including a cam portion for spreading the fingers, and a rivet stopping portion positioned below the end opening and projecting toward the fingers.

* * * * *